US006042202A

United States Patent [19]

Goppion

[11] Patent Number: 6,042,202

[45] Date of Patent: Mar. 28, 2000

[54] SEALED SHOWCASE

[75] Inventor: Alessandro Goppion, Milan, Italy

[73] Assignee: Goppion S.r.l., Trezzano sul Naviglio (MI), Italy

[21] Appl. No.: 09/092,874

[22] Filed: Jun. 8, 1998

[30] Foreign Application Priority Data

Jun. 6, 1997 [IT] Italy ..... MI97A1340

[51] Int. Cl.[7] ..... A47F 3/00

[52] U.S. Cl. ..... 312/140; 312/296; 312/139; 312/218; 292/302; 403/324

[58] Field of Search ..... 292/302; 49/480.1, 49/319, 316, 276; 403/324; 312/296, 114, 138.1, 139, 140, 263, 265, 265.1, 265.2, 265.3, 217, 218; 220/668, 665, 681, 614, 602

[56] References Cited

U.S. PATENT DOCUMENTS

| | | | |
|---|---|---|---|
| 1,030,444 | 6/1912 | Zabel | 312/140 |
| 1,594,076 | 7/1926 | Speros | 312/114 |
| 2,096,942 | 10/1937 | Suters | 312/140 |
| 2,627,950 | 2/1953 | Dath | 49/276 |
| 3,633,790 | 1/1972 | Voss | 312/140 X |
| 4,223,482 | 9/1980 | Barroero et al. . | |
| 4,497,524 | 2/1985 | Levings, Jr. et al. | 312/265 |

FOREIGN PATENT DOCUMENTS

| | | |
|---|---|---|
| 0280646 | 8/1988 | European Pat. Off. . |
| 0389764 | 10/1990 | European Pat. Off. . |
| 0590278 | 4/1994 | European Pat. Off. . |

*Primary Examiner*—Janet M. Wilkens
*Attorney, Agent, or Firm*—Sughrue, Mion, Zinn, Macpeak & Seas, PLLC

[57] ABSTRACT

The showcase includes a closure mechanism which compresses a seal by pulling the door panels against the main frame from inside. To this aim, a closure rod is mounted to the main frame which has alternating segments with expanded and contracted cross-sections, and a plurality of binding elements are mounted to the door panel for engagement by the rod. Each binding element has a rod-receiving socket of sufficient width to accommodate the expanded cross-section segments of the rod; the socket is formed with a side gap for admitting the rod whose width allows the contracted cross-section segments of the rod therethrough but not the its expanded cross-section segments.

11 Claims, 7 Drawing Sheets

SEALED SHOWCASE

BACKGROUND OF THE INVENTION

This invention relates to a sealed showcase, that is a showcase whose interior is fully isolated from the outside environment.

Showcases of this kind are on demand by museums, temporary exhibitions, and occasionally private collectors, specially to display frail objects which must be kept under a controlled atmosphere. The control may simply ensure isolation from dust and air drafts, or be more sophisticated and also encompass temperature, humidity, etc.

Such showcases usually comprise a main frame, mostly constructed from metal section bars, whereto panels are mounted to define the sealed interior of the showcase. In general, the panels are all fixed but one, which is arranged to be opened; with the emphasis being placed on a protected interior, it is only seldom that more than one panel are provided openable.

The tight fit of the fixed panels is often achieved by sealing the panels onto the main frame, and the main frame is constructed to ensure a sealed corner junction between adjacent panels. This means that adjacent panels will either be supported on a single continuous length of section bar free of any holes or openings that might communicate the showcase interior with the outside, or on multiple lengths of section bar connected together in a tight manner.

A tight closure is generally achieved for an opening or door panel by fitting an elastomer seal between the showcase main frame and the capping frame of the opening panel; clamping means are also provided to force the capping frame against the main frame and so compress the seal as to ensure a desired tight fit. Where a very tight fit is essential, threaded fasteners (screws, nuts, bolts, or the like) are used as the clamping means between the capping frame and the main frame.

Such means are easy and inexpensive to produce, and moreover, their clamping action is surely most effective. However, they are not always looked upon with much favor by the users (namely, museum staff or private collectors) because they involve the use of tools in which such users may well lack dexterity. This is particularly true of large-size showcases, wherein several distinct clamp points must be arranged to achieve an adequate compression of the seal all along its length.

The underlying problem of this invention is to provide a clamping arrangement which is simple to operate and can effectively produce a tight closure, that is, exert an adequate pressure force onto the seal.

SUMMARY OF THE INVENTION

Accordingly, this invention provides a sealed showcase, comprising a main frame, a plurality of panels so mounted to the main frame as to enclose an interior space in a tight manner, at least one of the panels being an opening panel movable relative to the main frame, a capping frame of the opening panel, a seal placed between the capping frame and the main frame, and seal compressing means arranged to act between the capping frame of the opening panel and the main frame, characterized in that the seal compressing means comprise:

a closure rod formed with expanded cross-section segments and contracted cross-section segments, and being guided for axial movement, on the main frame in a lengthwise direction along one side of the main frame, between an opening position and a closure position;

at least a binding element, each having a closure rod receiving socket whose cross-section can accommodate the expanded cross-section segments, the closure rod receiving socket being formed with a side gap for admitting the closure rod, which gap is sized to allow the contracted cross-section segments therethrough but not the expanded cross-section segments, the binding elements being so mounted to the capping frame as to engage the rod when the panel is brought close against the main frame, specifically engage the expanded cross-section segments with the rod in the closure position and the contracted cross-section segments with the rod in the opening position.

In a showcase of this type, the clamping action is provided by the closure rod engaging in its respective receiving sockets formed in the binding elements attached to the opening panel. The pressure force on the-seal may be set as desired by suitably selecting the relative dimensions of the expanded and contracted cross-sections. To open and close, the rod is simply slid lengthwise to simultaneously clamp a whole side of the opening panel, regardless of the number of clamping points (that is, clamping elements) provided.

The cross-sectional shape of the rod may be varied. However, for convenience in manufacturing and assembling, the closure rod is preferably arranged to have coaxial circular cross-sections, of a small diameter at the contracted cross-section segments and a large diameter at the expanded cross-section segments.

Preferably, the closure rod has connection taper portions formed between the contracted cross-section segments and the expanded cross-section segments. These tapers make for a smoother sliding movement of the rod into the closure position, and are preferably frusto-conical.

Where the rod has circular cross-sections, the socket in the binding elements has preferably a substantially circular cross-sectional shape of a diameter barely larger than the large diameter of the rod. The expression "substantially circular" is used here to indicate that the cross-section is circular in shape but for a missing portion at the gap. The expression "barely larger" is used to indicate that the difference is a minimum required for the clearance between the socket and the rod to allow of their mutual sliding movement. This ensures an effective fit of the rod in the securing elements.

Likewise, where the rod cross-sections are circular in shape, the width dimension of the side gap in the binding elements will preferably be between the small and large diameter dimensions of the rod.

The closure rod may be mounted and guided on the main frame in any of several ways. Preferably, the main frame includes a slideway for the rod which is formed of channel pieces having a diameter barely larger than the large diameter of the rod. Here again, the expression "barely larger" means that the difference is a necessary minimum for the clearance between the channel pieces and the rod to allow of their mutual sliding movement.

The binding elements shall have a shorter axial length than the contracted cross-section segments of the rod, so that they can become disengaged. Preferably, there is one contracted cross-section rod segment for each binding element, and the axial length of the contracted cross-section segment barely exceeds the axial length of the binding element. The word "barely" is again used to indicate that the difference should be the smallest possible. In this way, the axial extension of the clamping points, or regions, can be maximized.

A variety of means may be provided for shifting the rod in the axial direction. For example, in a particularly simple embodiment, such means can comprise:

a separate outer slide member formed with a handgrip and a tang integrally formed with each other;

a socket, formed laterally in the rod, for releasably receiving the tang therein;

a socket access window, provided in the main frame and/or the capping frame of the opening panel.

The closure rod may also serve useful ancillary functions. For example, the main frame may comprise a plurality of section bars joined together, and the channel pieces that form the slideway for the rod on the main frame may be secured to different section bars so that the closure rod can cooperate in holding such different bars together.

BRIEF DESCRIPTION OF THE DRAWINGS

Further features and advantages of a showcase according to the invention will be more clearly apparent from the following description of a preferred embodiment thereof, given with reference to the accompanying drawings.

DETAILED DESCRIPTION OF THE INVENTION

Figure 1:
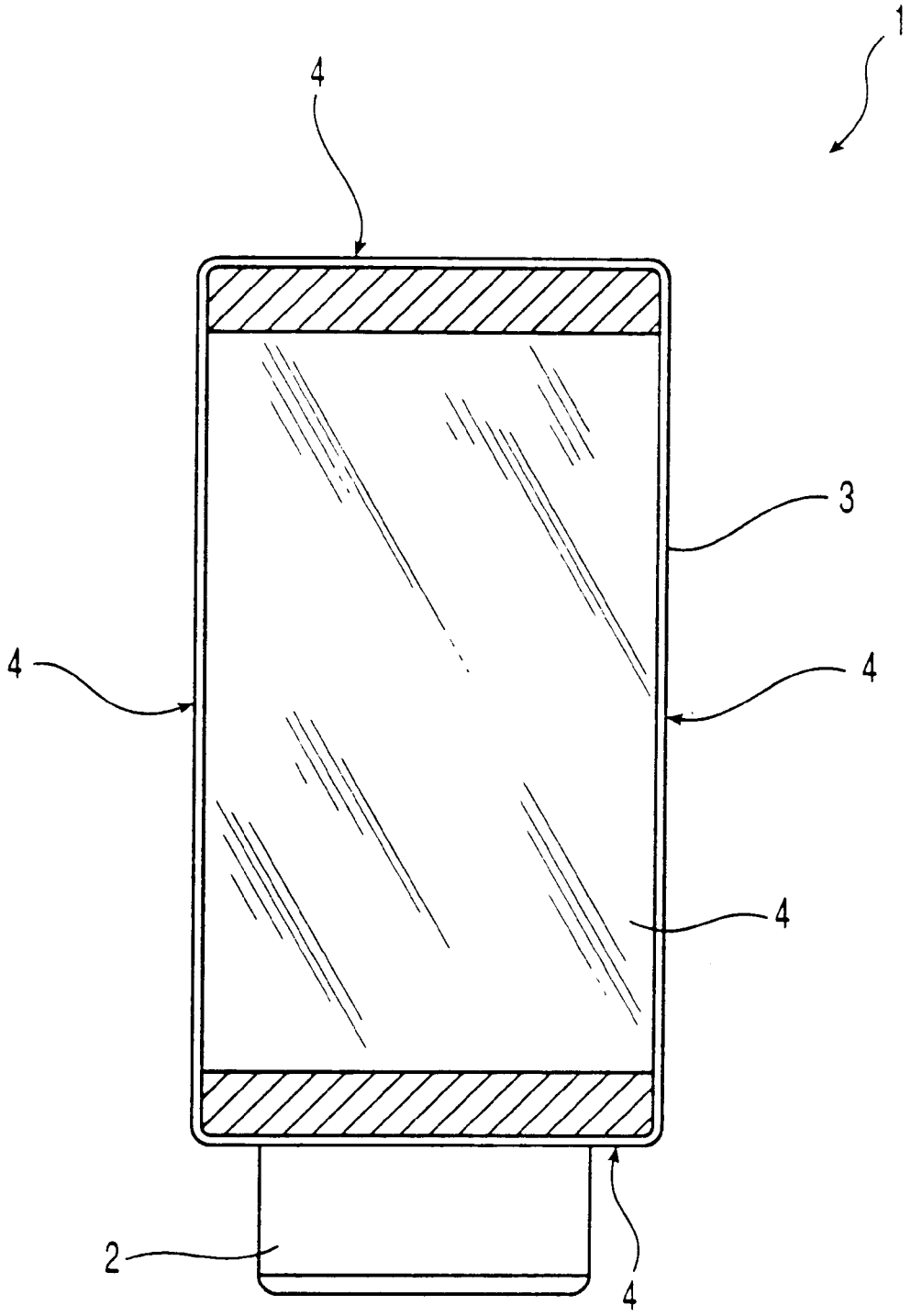
FIG. 1 is a front view of a showcase according to the invention.

In FIG. 1, generally indicated at 1 is a showcase which, in the example shown, is parallelepipedic in shape and comprises a base 2 on which a main frame 3 is erected having six panels 4 mounted thereto in a tight sealed manner. Thus, an inner space I is defined which is sealed up from the outside space E.

The main frame 3 is formed of a plurality of extruded section bars connected to one another.

Figure 8:
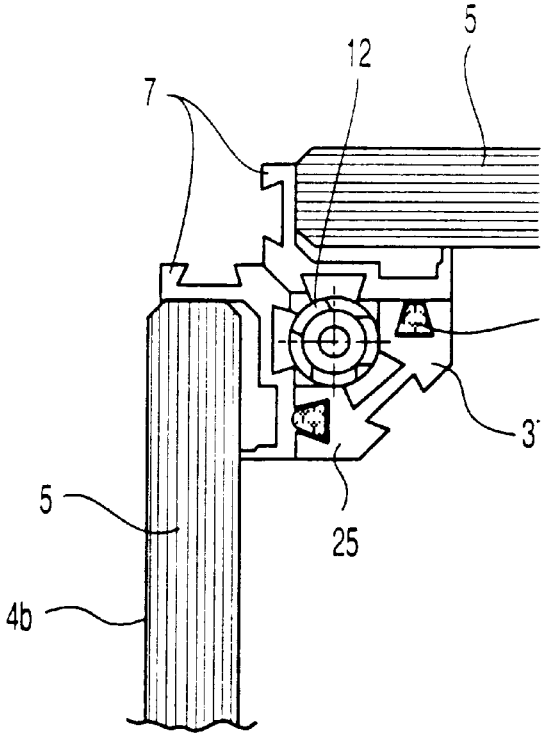
FIG. 8 is a sectional view of part of two adjacent panels in the showcase of FIG. 1.

The panels 4 may be fixed or openable; for accessing the inner space I, obviously at least one of the panels 4 would be allowed to open, as indicated at 4*a*. The opening panel 4*a* comprises a glass pane 5 which is mounted in a capping frame 6 constructed of extruded section bars. The fixed panels may or may not be provided with a capping frame, as explained hereinafter (FIG. 8).

Figure 2:
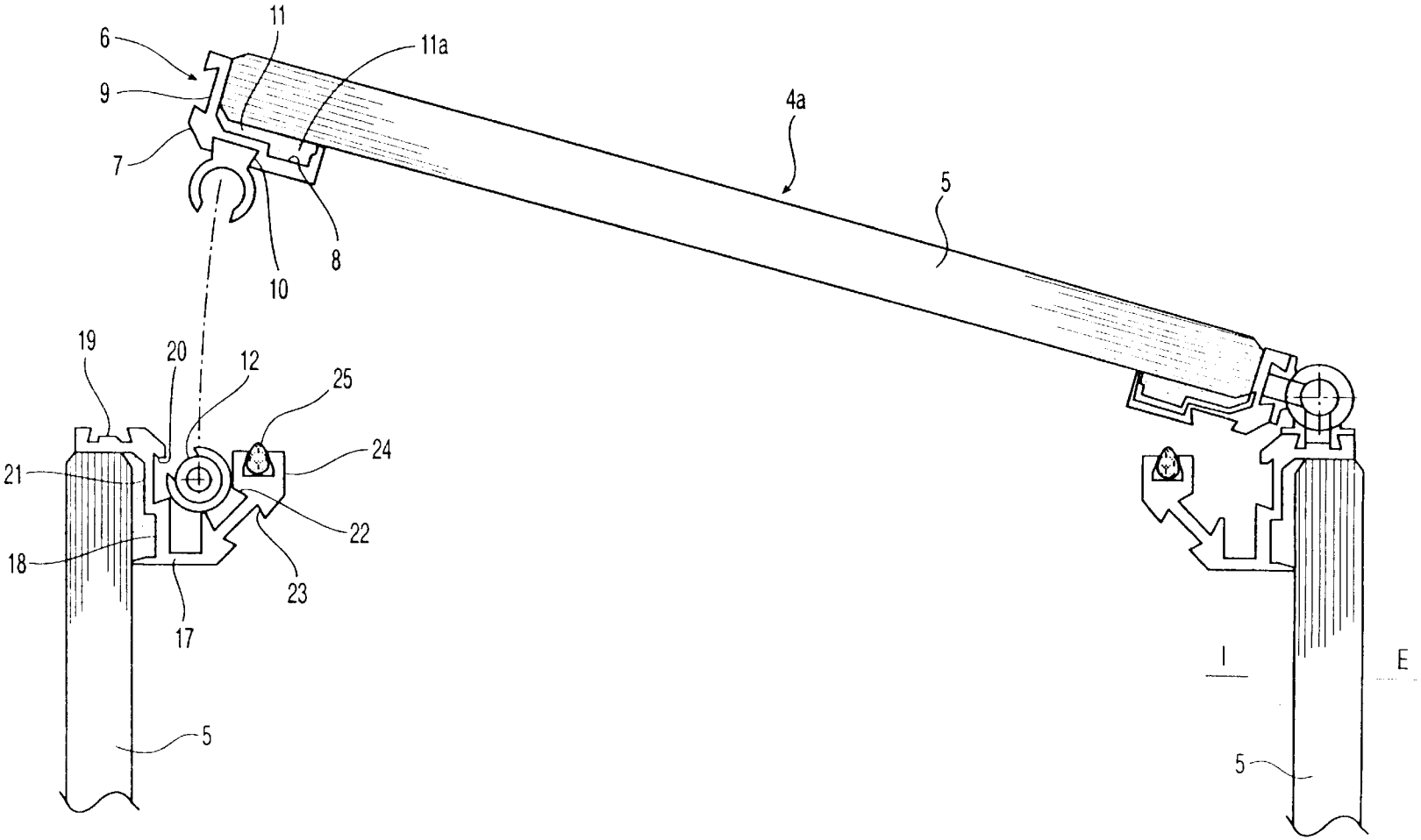
FIG. 2 is a sectional view of an opening panel and part of two fixed panels adjacent to it in the showcase of FIG. 1, the opening panel being shown in its open position.

Shown in FIG. 2 is an opening panel 4*a* which comprises a glass pane 5 mounted in a capping frame 6, the latter being constructed of lengths of section bar 7. The section bar 7 is basically an angle bar, and is disposed, relative to the pane 5, to clasp it peripherally on the inside.

The cross-sectional shape of the bar 7 comprises a groove 8, a groove 9, a groove 10, and a depression 11.

The groove 8 is facing the pane 5, and is intended to accommodate corner pieces (not shown) for joining at 90° together two section bars 8 at the corners of the capping frame 6. The groove 9 is facing in the opposite direction from the pane 5 and has a dovetail cross-sectional shape effective to transversely retain elements inserted therein axially. The groove 10 is set at 90° to the groove 9 (i.e., extends in imaginary continuation of the edge of the pane 5 in the panel 4*a*), and also has a dovetail shape in cross-section. The depression 11 is contiguous with, and partly overlaps, the groove 8; the depression 11 is filled with an adhesive 11*a* for adhesively sealing the pane 5 to the capping frame 6.

At the location of the opening panel 4*a*, the main frame 3 is constructed of pieces of a section bar 17. The section bar 17 includes a portion having a cross-sectional shape similar to that of the section bar 7, that is, formed with grooves 18, 19, 20 and a depression 21 which correspond with those of the section bar 7. The section bar 17 further includes a transverse portion, extending obliquely in front of the groove 20, which is formed with three grooves 22, 23 and 24. The groove 22 has the same shape as the groove 20 and is oriented toward it, at an inclination angle of 45°; the groove 23 has a dovetail shape in cross-section, and extends to face in the opposite direction from the groove 22; the groove 24 has a narrow dovetail shape in cross-section, and extends at the end of the transverse portion of the section bar 17 in a parallel direction to the groove 19 toward the opening panel 4*a*. The depression 21 is filled with an adhesive 21*a* for adhesively sealing the pane 5 to its respective wall 4.

A seal 25 made of rubber or the like (preferably, silicone or VITON™) is mounted in the groove 24 to provide a tight fit of the section bar 7 which forms the capping frame 6 to the section bar 17 which forms the main frame 3, with the opening panel 4*a* in the closed position.

The showcase 1 also comprises a closure rod 12 which is guided for movement in the axial direction on the main frame 5. The rod 12 is substantially cylindrical and circular in cross-section, but has a non-constant diameter. In fact, the rod 12 includes a succession of segments 13 of expanded cross-section and segments 14 of contracted cross-section, separated by taper portions 15. The rod has the same large diameter at all the expanded cross-section segments 13, and has the same small diameter at the contracted cross-section segments 14; at the tapers, the rod shape is frusto-conical. All the rod segments lie coaxial with one another.

Figure 3:
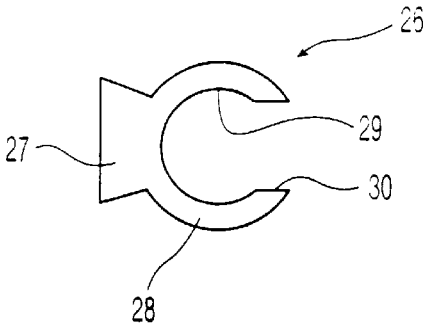
FIG. 3 is a sectional view, drawn to an enlarged scale, of a section bar used for the binding elements and the slideway of the closure rod of the showcase shown in FIG. 1.

Mounted to the capping frame 6 are binding elements 16 for releasably engaging the closure rod 12. The binding elements 16 consist of pieces of extruded metal section bar 26 (shown in FIG. 3), and are substantially omega-shaped in cross-section with a dovetail base 27 and an open circular body 28. The cross-sectional shape of the base 27 matches the cross-section of the grooves 10 (as well as those of the grooves 20 and 22, since these have the same cross-sectional shape as the grooves 10), so that it can be fitted thereinto. The body 28 is formed with a circular inner socket whose diameter is barely larger than the large diameter of the rod 12, that is the diameter of the expanded cross-section segments 13; the socket 29 is open laterally by the provision therein of a side gap 30 whose width dimension is contained between the small and the large diameter of the rod 12. In practice, the rod 12 can only enter and exit the socket 29 through the gap 30 with one of its contracted cross-section segments 14 aligned to the gap 30; conversely, whenever an expanded cross-section segment happens to be in line with the gap 30, the rod 12 will either be held within the socket 29 or shut out of it, according to where it happens to be positioned.

The rod 12 is guided in a slideway which is formed on the main frame 3 using channel pieces 31 cut from the same section bar 26 as is used for the binding elements 16 and fitted into the grooves 10 and/or 22.

Figure 4:
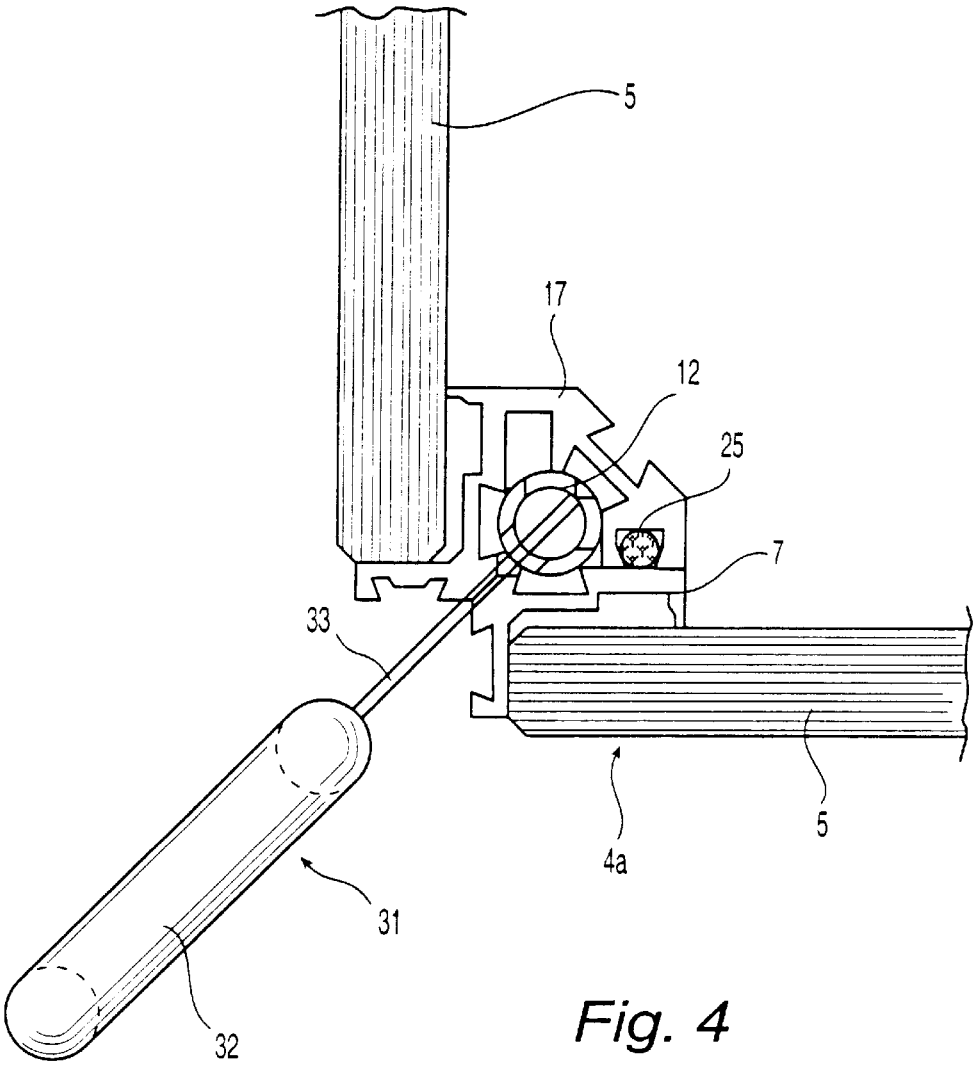
FIG. 4 is a sectional view of part of two adjacent panels of the showcase in FIG. 1, taken at the actuation means for the closure rod.
Figure 5:
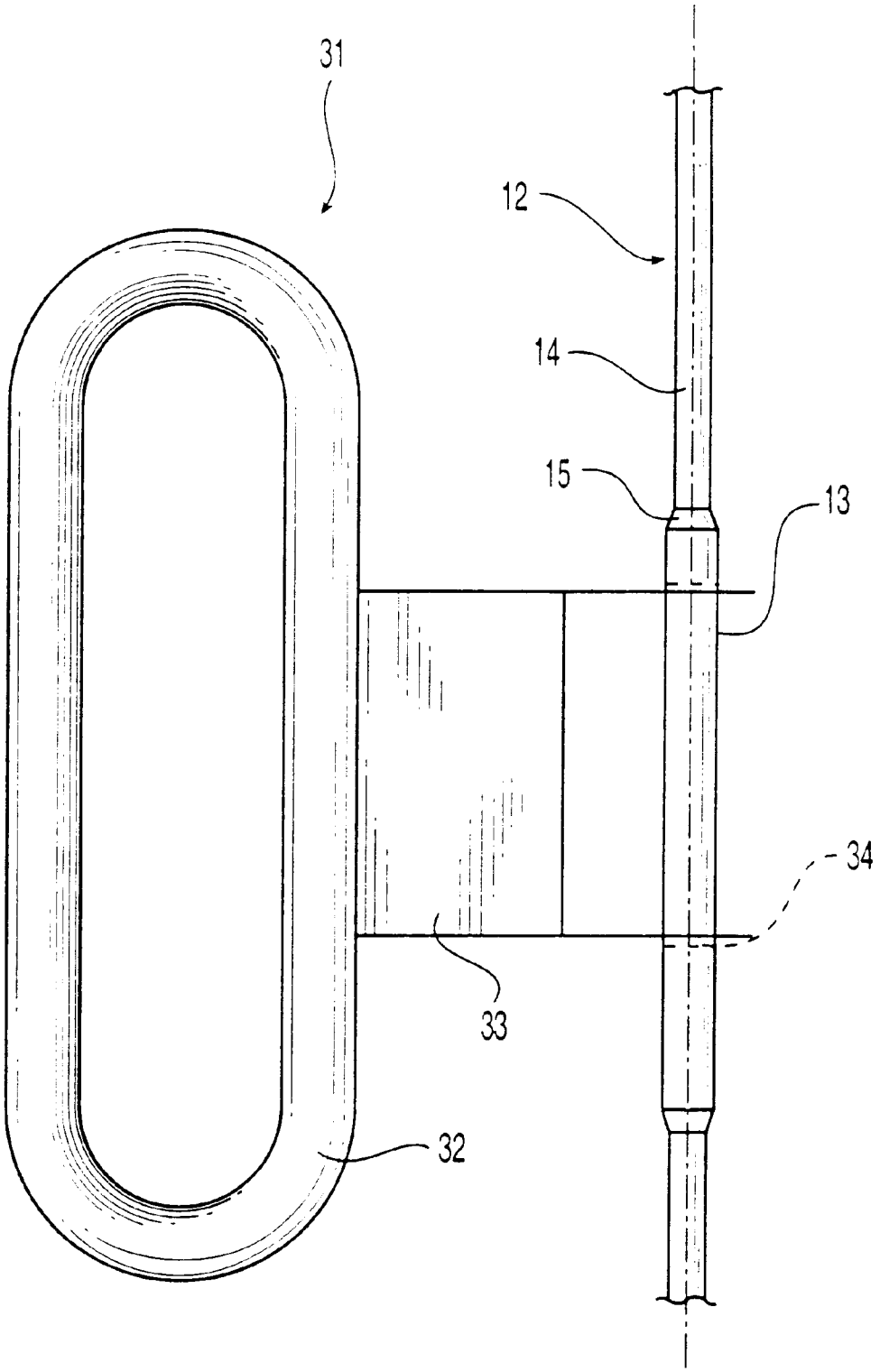
FIG. 5 is a side view of the closure rod and its actuation means.
Figure 6:
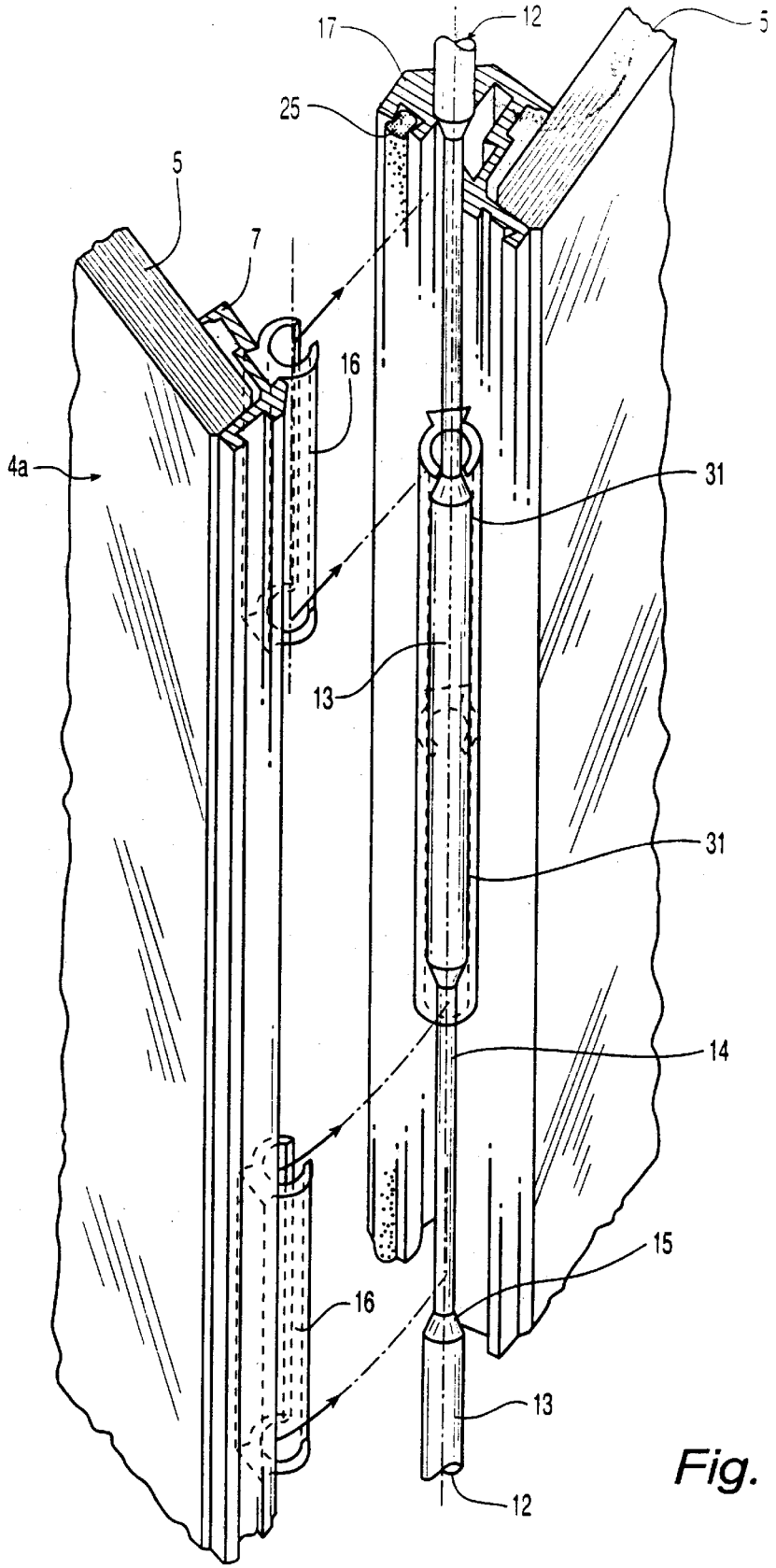
FIGS. 6 and 7 are fragmentary perspective views of a movable panel of the showcase in FIG. 1, in the open and closed conditions, illustrating the operation of the closure rod.
Figure 7:
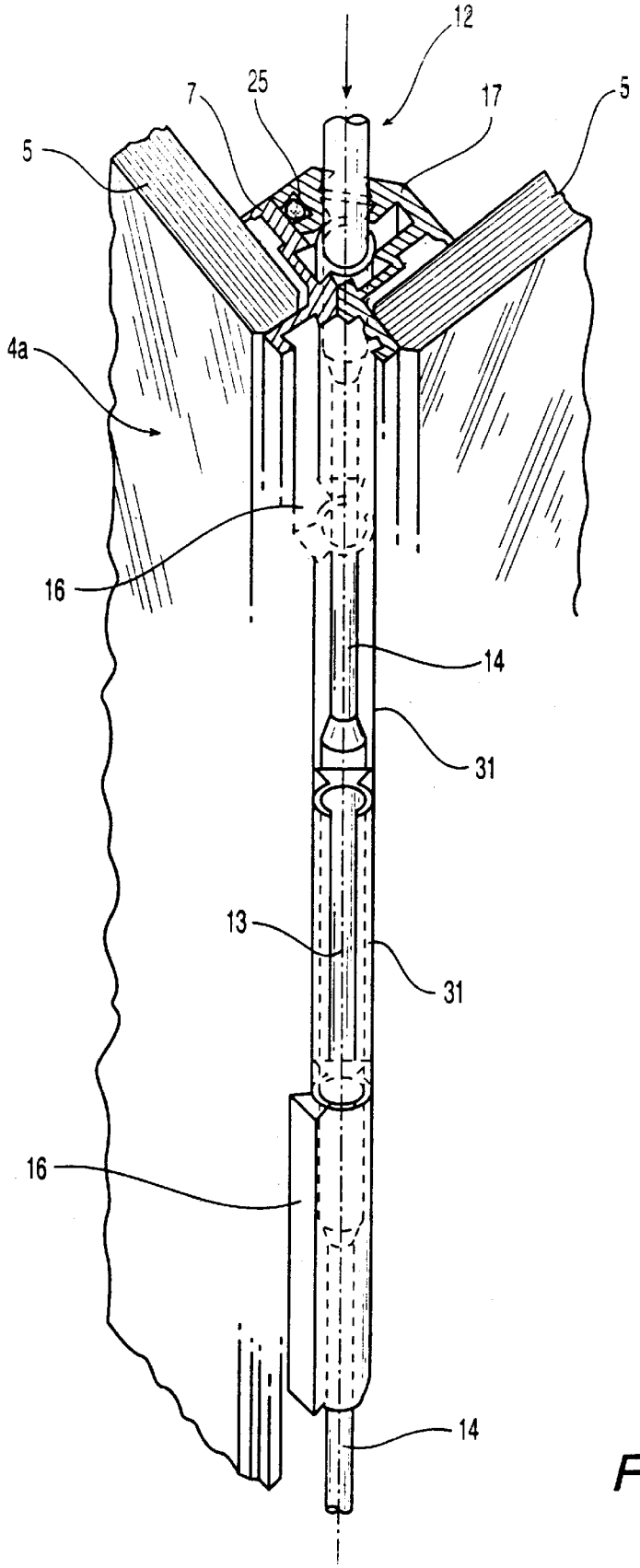

A means is also provided for actuating the closure rod 12 in the axial direction. This means comprises, as shown in FIGS. 4 and 5, a slide member 31 which locates on the showcase 1 exterior, is separated from the showcase, and is formed with a handgrip 32 and a tang 33 rigid with each other; a socket 34 formed laterally in the rod 12 to removably accommodate the tang 33, and a window (not shown) cut through the main frame 3 for access to the socket 34.

To shut the opening panel 4*a*, the rod 12 is positioned—by means of the slide member 31—such that its contracted cross-section segments are aligned to the binding elements 16. In this way, the rod 12 is enabled, as shown in FIG. 8, to enter the sockets 29 of the binding elements 16 through the side gaps 30, and the panel 4*a* can be brought fully against the main frame 3.

Once received in the sockets 29, the rod 12 can be slid axially—by means of the slide member 31—to bring the expanded cross-section segments 13 into alignment with the binding elements 16. This may require that some pressure be exerted on the opening panel 4*a* to compress the seal 25. In any case, once the rod 12 is slid a sufficient distance, it becomes engaged with its expanded cross-section segments 13 in both the sockets 29 of the binding elements 16 and the sockets 29 of the channel pieces 31. By virtue of the minimal clearance allowed between the rod 12 and the sockets 29, the opening panel 4*a* will be held firmly against the main frame 3 to provide a desired compression of the seal 25.

The opening procedure would obviously be the reverse of the above.

The binding elements 16 (and correspondingly, the contracted cross-section segments 14) may be provided in any desired number along each side of the opening panel 4*a* of the showcase 1. Understandably, this number will be the larger the more stringent the requirement for retentive power placed on the panel 4*a*, e.g. in view of the panel size, the type of seal used, and the pressure to be exerted. For small-size showcases equipped with a properly hinged opening panel and requiring only a moderate degree of tightness, a single closure rod along the opposite side from the hinge, and one or two binding elements, may be sufficient. A large-size door panel with stringent tightness requirements usually would have to be provided with four closure rods along the four sides of the panel, each with a large number of binding elements.

Figure 9:
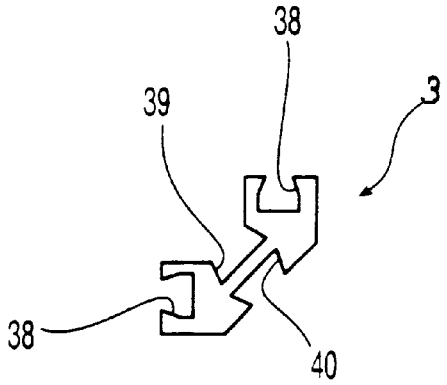
FIG. 9 is a sectional view, drawn to an enlarged scale, of a section bar shown in the detail view of FIG. 8.

FIGS. 8 and 9 illustrate another detail of a showcase according to the invention; in particular, FIG. 8 shows a portion of the main frame 3 whereat two panels 4*b*, both provided with a capping frame 6, meet together. Accordingly the main frame, instead of being constructed from lengths of the section bar 17, is constructed from lengths of a section bar 37 which substantially corresponds in shape to the transverse portion of the section bar 17. Specifically, the section bar 37 (shown in greater detail in FIG. 9) has a symmetrical shape in cross-section which comprises two identical end grooves 38, and two oppositely located middle grooves 39 and 40. The end grooves 38 have a narrow dovetail cross-section similar to the groove 24, for accommodating the seal 25; the groove 39 is similar to the groove 22, and the groove 40 is similar the groove 23.

Both panels 4*b* could be opening panels, in which case the groove 39 would receive the necessary channel pieces 31. However, if it is arranged for only one of the panels 4*b* to be opened, then the channel pieces 31 can advantageously be received in both the groove 39 and the groove 10 of the capping frame 6 of the fixed one of the panels 4*b*. Thus the rod 12, once inserted through the channel pieces 31, will contribute substantially to securing the section bar 37 of the main frame 3 and the capping frame section bar 7 together.

A showcase constructed in accordance with this invention will provide a highly effective sealing arrangement which can be termed "active", as compared to the "passive" character of conventional arrangements. In fact, the seal performs here its sealing function by virtue of the compressive force developed by a pull exerted on the door panel from inside, via the rod mechanism. In the prior art arrangements, the seal was instead compressed directly by the door panel being pushed against the main frame.

What is claimed is:

1. A sealed showcase, comprising a main frame, a plurality of panels so mounted to the main frame as to enclose an interior space in a tight manner, at least one of the panels being an opening panel movable relative to the main frame, a capping frame of the opening panel, a seal placed between the capping frame and the main frame, and seal compressing means arranged to act between the capping frame of the opening panel and the main frame, characterized in that the seal compressing means comprise:

a closure rod formed with expanded cross-section segments and contracted cross-section segments, and being guided for axial movement on the main frame, in a lengthwise direction along one side of the main frame, between an opening position and a closure position;

at least one binding element, said at least one binding element having a closure rod receiving socket whose cross-section can accommodate the expanded cross-section segments, the closure rod receiving socket being formed with a side gap for admitting the closure rod, which gap is sized to allow the contracted cross-section segments therethrough, but not the expanded cross-section segments, said at least one binding element being so mounted to the capping frame as to engage the rod when the opening panel is brought close against the main frame, specifically engage the expanded cross-section segments with the rod in the closure position and the contracted cross-section segments with the rod in the opening position.

2. A showcase according to claim 1, wherein the closure rod has coaxial circular cross-section, with a small diameter at the contracted cross-section segments and a large diameter at the expanded cross-section segments.

3. A showcase according to claim 2, wherein the closure rod is formed with taper portions between the contracted and expanded cross-section segments.

4. A showcase according to claim 3, wherein the taper portions are frusto-conical in shape.

5. A showcase according to claim 2, wherein the socket of said at least one binding element has a substantially circular cross-section, with a diameter barely larger than the large diameter of the rod.

6. A showcase according to claim 2, wherein the gap in said at least one binding element has a width dimension which lies between the small diameter dimension and the large diameter dimension of the rod.

7. A showcase according to claim 2, wherein the main frame includes a slideway for the rod which is formed from channel pieces having a diameter barely larger than the large diameter of the rod.

8. A showcase according to claim 7, wherein the main frame comprises a plurality of section bars joined together, and the channel pieces which form the slideway for the rod on the main frame are secured to different section bars so that the closure rod will cooperate in holding such different bars together.

9. A showcase according to claim 1, wherein a respective one of said contracted cross-section segments of the rod is provided for each said binding element, and wherein the axial length of each of the contracted cross-section segments barely exceeds the axial length of each said binding element.

10. A showcase according to claim 1, comprising an actuation means for shifting the closure rod in its axial direction.

11. A showcase according claim 10, wherein the actuation means for the closure rod comprises:

a separate outer slide member formed with a handgrip and a tong formed integrally with each other; and a socket sized laterally in the rod, for releasably receiving the rod therein.

* * * * *